United States Patent [19]

Vriens et al.

[11] Patent Number: 4,899,080

[45] Date of Patent: Feb. 6, 1990

[54] PROJECTION TELEVISION DISPLAY TUBE WITH COOLING MEANS AND DISPLAY DEVICE HAVING SUCH A DISPLAY TUBE

[75] Inventors: Leendert Vriens; Gerrit B. Gerritsen; Willem M. Van Alphen, all of Eindhoven, Netherlands

[73] Assignee: U.S. Philips Corporation, New York, N.Y.

[21] Appl. No.: 298,378

[22] Filed: Jan. 18, 1989

Related U.S. Application Data

[63] Continuation of Ser. No. 738,199, May 24, 1985, abandoned.

[30] Foreign Application Priority Data

Jun. 1, 1984 [EP] European Pat. Off. ..... 84200784

[51] Int. Cl.[4] ..... H01J 29/86; H01J 5/20

[52] U.S. Cl. ..... 313/477 R; 313/22; 313/35; 313/44; 313/45; 358/245

[58] Field of Search ..... 313/22, 35, 36, 44, 313/45, 477 R; 358/245, 252, 255

[56] References Cited

U.S. PATENT DOCUMENTS 4,529,905 7/1985 Ohkoshi et al. ..... 313/35

4,651,047 3/1987 Comberg et al. ..... 313/22

*Primary Examiner*—Kenneth Wieder

*Attorney, Agent, or Firm*—John C. Fox

[57] ABSTRACT

Projection television display tubes having an evacuated envelope (1) with a display window (4) which on its inside comprises a display screen (5) and in front of which a light permeable second window (6) is provided on its outside, a cooling liquid (16) flowing through the space (7) between the display window (4) and the second window (6) from at least one inlet aperture to at least one outlet aperture (17) namely by temperature differences in said cooling liquid. When in such a projection television display tube at the area of the windows (4, 6) and around the said space (7) a cooling jacket (8) is provided which comprises at least one duct (9) which transports the cooling liquid (6) from the outlet aperture(s) to the inlet aperture(s) of the said space, an effective cooling is obtained at a power between 12 and 25–30 W without external pipes or a heat exchanger. As a result of the circulation of the cooling liquid around the tube end at the area of the windows there is a good temperature compensation so that fewer stresses occur in the glass of the display tube.

15 Claims, 4 Drawing Sheets

PROJECTION TELEVISION DISPLAY TUBE WITH COOLING MEANS AND DISPLAY DEVICE HAVING SUCH A DISPLAY TUBE

This is a continuation of application Ser. No. 738,199, filed May 24, 1985, now abandoned.

BACKGROUND OF THE INVENTION

The invention relates to a projection television display tube having an evacuated envelope with a display window which on its inside comprises a display screen and in front of which a light permeable second window is provided on its outside, a cooling liquid flowing through the space between the display window and the second window from at least one inlet aperture to at least one outlet aperture, namely by temperature differences in said cooling liquid.

The invention also relates to a picture display device having one or three such projection television display tubes.

Such a display tube is known from U.S. Pat. No. 4,529,905, P. Koshictal. By means of an electron beam a field is written on the display screen which usually comprises a phosphor layer or a pattern of different phosphors. As a result of the electron bombardment the temperature of the phosphor increases so that the luminous efficiency of the display screen decreases ("thermal quenching"). This phenomenom occurs in particular in display tubes for projection television in which for maintaining the required high luminous densities the display screen is scanned by electron beams of high beam currents. At the same time the temperature of the display window increases and a temperature gradient is formed at the display window. This gradient causes a mechanical stress in the display window which consists, for example, of glass. At high electron beam current and consequently high thermal load, this may lead to fracture of the display window. In order to reduce said mechanical stresses in the display window by temperature differences ("thermal stress") and to avoid the reduction of the luminous efficiency it is known from the already mentioned U.S. Pat. No. 4,529,905 to cool the display window and the display screen connected thereto. The space between the display window and the second window filled with cooling liquid in a first described embodiment is surrounded on the top, at the bottom and, laterally by a metal cooling member which serves as a spacing member and as a heat radiator. As a result of the rise in temperature of the display window the cooling liquid heated by the display window moves along the display window upwards and past the second window downwards as a result of which the thermal energy from the centre of the display window is also dissipated via the cooling member. At low load, for example smaller than 5 W, the thermal energy is dissipated to the second window substantially by conduction. At higher load the above-described liquid flow occurs with an associated additional cooling by the cooling member, which however, is little effective. Moreover, an embodiment is described in which the cooling liquid is applied to the space from the top side of the space through pipes or hoses and through a cooling chamber to the lower side, namely by flow caused by temperature differences in the cooling liquid. A disadvantage of such a tube is that when the tube in a projector has to be replaced the cooling liquid must be removed and the hoses and pipes, respectively, must be disconnected from the display tube.

A similar liquid cooling is suggested in U.S. Pat. No. 4,734,613 in which a laminar flow of the cooling liquid along the display window is used at a flow rate of approximately 5 $cm^3/s$. With this type of cooling a power up to 60–80 W can be dissipated. The backflow of the cooling liquid from the outlet aperture to the inlet aperture of the space occurs through hoses or pipes and by means of a pump provided in said system of hoses and pipes. In said system of hoses or pipes a cooling chamber (heat exchanger) is also incorporated. In such tubes in which an accelerating voltage of 29 kV is used, 60–80 W corresponds to an average beam current of 2–3 mA with peak currents up to approximately 10 mA.

OBJECTS AND SUMMARY OF THE INVENTION

It is the object of the invention, starting from the above-described prior art, to provide a display tube having a cooling system which provides an active cooling at a power between 12 and 25–30 W.

Another object of the invention is to provide a display tube having a cooling without additional pipes and individual heat exchangers.

In order to achieve these objects a display tube of the type mentioned in the opening paragraph is characterized according to the invention in that at the area of the windows and around the said space a cooling jacket is provided having at least one duct which transports the cooling liquid from the outlet aperture(s) to the inlet aperture(s) of the said space.

In this cooling the cooling liquid generally flows laminarly past the warm display window and absorbs heat there. The cooling liquid then flows from the outlet aperture or apertures through the duct in the cooling jacket where the cooling liquid delivers its thermal energy to the cooling jacket to the inlet aperture(s). As a result of the circulation of the liquid a better temperature control is obtained than in the known cooling system having a single cooling chamber. As a result of this the stress in the glass of the display tube is further reduced.

The free convection liquid flow by temperature differences in the cooling liquid is comparatively slow. An essential temperature difference $\Delta T$ occurs (for example 10° C.) between the temperatures of the cooling liquid at the inlet and outlet apertures. At a produced power of 28 W a $\Delta T$ of approximately 10° C. is obtained at a liquid flow of approximately 0,3 $cm^3/s$ for a liquid having a density p of 1 $g/cm^3$ and a thermal capacity Cp of approximately 4.2 J/g°C. (1 cal/g°C.) as for water. The required liquid flow then is only approximately 6% of the liquid flow of approximately 5 $cm^3/s$ in tubes corresponding to the said Netherlands Pat. Application No: 8300114.

A further advantage of the display tube according to the invention is that no outer pipes, hoses, heat exchangers and pumps are necessary as a result of which a much simpler assembly of the tubes in a (projection) arrangement for displaying pictures is possible.

The cooling in a display tube according to the invention is essentially more effective than in the first embodiment of the cooling described in the already mentioned Netherlands Pat. Application No. 8003360 because the cooling liquid between the display window and the second window flows substantially in only one direction and is cooled in the cooling jacket.

The flow resistance in the duct and in the ducts, respectively, of the cooling jacket is preferably smaller than in the space between the display window and the second window. When this is the case the liquid flow by temperature differences is started more easily.

At least the outer wall of the cooling jacket preferably consists of metal and may be provided with cooling fins. Said outer wall of the cooling jacket in the picture display device is preferably brought in thermal contact with a member having a large thermal capacity. Said member may, for example, be the support with the lens system of the device, which support serves as a heat sink. It is also possible to cool the fins with air by forced cooling.

A preferred embodiment of a display tube according to the invention is characterized in that a duct through which the cooling liquid flows is bounded partly by a seal, for example of glass, extending substantially parallel to the direction of flow in the space, or a metal strip between the display window and the second window. When two strips are used on two sides of the display window they may at the same time serve as spacer elements between the display window and the second window.

It is also possible for the second window to be the first element of the optical system of lenses of the picture display device.

The tubes according to the invention may be provided in a picture display device with their cooling jacket to a second cooling system. This second cooling system, for example liquid-filled pipes, can dissipate the thermal energy from the cooling jacket to a suitable place, for example to the rear side of the arrangement. Said cooling system may form an integral part of the device. For the cooling liquid in said second system the requirement only holds that it readily transports the thermal energy (good thermal conductivity and low viscosity). In said second system there are no requirements with respect to contaminations, optical transmission and refractive index of the liquid. Said second cooling system may also be filled only partly with a liquid which evaporates above a temperature of 40 to 50° C. and that in such manner that the second system is active as a heat pipe. The advantage of such a construction is the extremely effective heat transport and the low filling weight.

An embodiment of the invention is shown in the drawing and will be described in detail hereinafter. In the drawing

DESCRIPTION OF THE PREFERRED EMBODIMENTS

Figure 1:
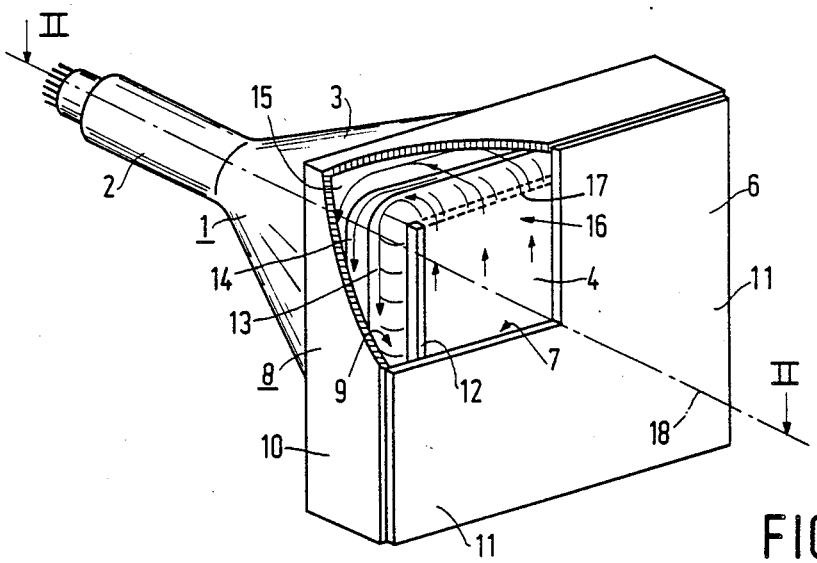
FIG. 1 is an elevation, partly broken away, of a display tube according to the invention.

FIG. 1 is diagrammatic elevation partly broken away of a display tube according to the invention. Said display tube comprises an envelope 1 which consists of a neck 2 and a cone 3 and is sealed by means of a display window 4. A display screen 5 (see FIG..2) is provided on the inside of said display window. A light permeable second window 6 is provided substantially parallel to the outside of the display window 4. Around the tube end at the area of the windows 4 and 6 and the space 7 between these windows a cooling jacket 8 is provided. Said cooling jacket comprises a duct 9 which is bounded by an outer wall 10 of the cooling jacket, the side edge 11 of the second window 6, a glass strip 12, the edge of the display window 4, the edge of the cone 14 and the rear wall 15 of the cooling jacket. Any differences in expansion between the outer wall 10 and the tube end can be compensated by the flexible rear wall 15 of the cooling jacket. The space 7 and the duct 9 are filled with cooling liquid 16 (for example water or an ethylene glycol-water mixture having a lower melting-point and a higher boiling-point than water).

The thermal energy generated in the display screen is absorbed via the display window by the cooling liquid so that this becomes locally warmer and moves to a higher point in the system. The warm cooled liquid leaves the space 7 via the outflow aperture 17 indicated in broken lines and reaches the cooling jacket 8. In the duct 9 of said cooling jacket the cooling liquid delivers the thermal energy absorbed therein partly to the wall 10 and the rear wall 15 of the cooling jacket and flows into the space 7 via an inlet aperture which is not visible. The direction of flow of the cooling liquid is indicated by arrows. Because the cooling liquid flows around the tube end and is not cooled in a separate cooling chamber or a heat exchanger, a better temperature compensation is obtained than in those systems having a separate cooling chamber. Such a tube having water or an 80% ethyleneglycol-20% water mixture as a cooling liquid and a display screen having a 5 inch diagonal (12.7 cm) at a load of 28 W, constantly provided a rise in temperature of the cooling liquid for the central display window of only 37±2° C. The cooling jacket comprised cooling fins and was cooled with air but not force-cooled. Moreover, there was some additional cooling by the contact with the device in which the tube was connected.

Figure 2:
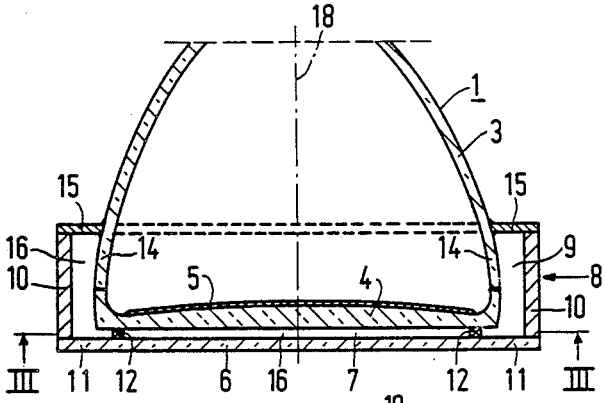
FIG. 2 is a horizontal sectional view through the tube shown in FIG. 1.

FIG. 2 is a horizontal sectional view through the tube shown in FIG. 1 in which the cross-section comprises the central axis 18. The reference numerals correspond to those of FIG. 1.

Figure 3:
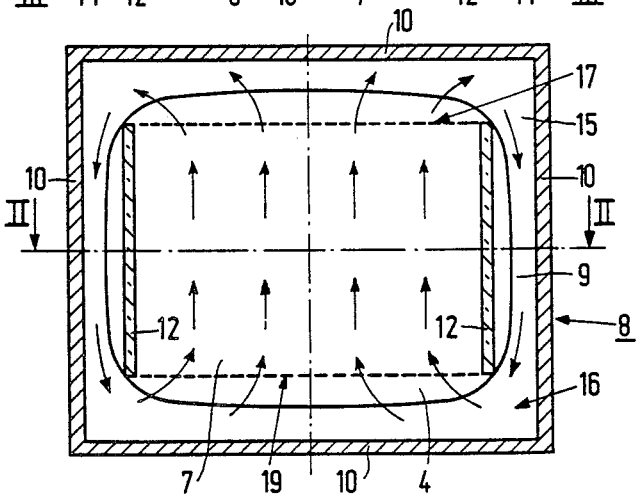
FIG. 3 is a vertical sectional view at right angles to the tube axis in the tube shown in FIGS. 1 and 2, FIGS. 4 and 5 are horizontal sectional views through another tube according to the invention.

FIG. 3 is a vertical sectional view at right angles to the tube axis 18. The reference numerals again correspond to those of FIG. 1. The cooling liquid 17 flows through the space 7 upwards and leaves said space via the outflow aperture 17 (broken line) and then flows through the duct 9 of the cooling jacket 8 to the inlet aperture 19 (broken line).

Figure 4:
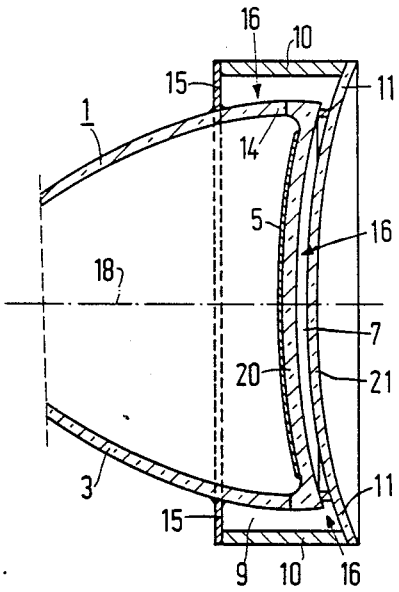

FIG. 4*a* also is a horizontal sectional view through a tube according to the invention mainly corresponding to FIG. 2. The display window 20 in this case is curved. In order to maintain the optical advantages of the curved display window the second window is also curved. The cooling liquid now flows through the space between the curved display window 20 and the second window 21.

Since the radius if curvature of the second window 21 is chosen to the smaller than that of the display window 20, as shown in FIG. 4*b*, or since a non-spherical form is chosen for the second window 21 the display can be optimized. The outer wall 10 of the cooling jacket is provided with cooling fins 22. The reference numerals in those parts which correspond to those of FIG. 1 are the same as in FIG. 1.

Figure 5:
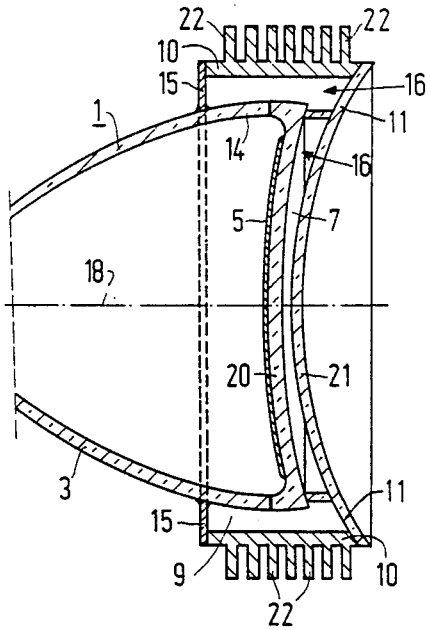

FIGS. 5*a, b* and *c* are a front elevation, a partial vertical sectional view, and a partial horizontal sectional view, respectively, through another embodiment of a display tube according to the invention. This display tube comprises an evacuated envelope 30 which consists of a neck (not shown), a cone 31 and a display window 32 on which a display screen 42 is provided. Immediately in front of the display window 32 and the second window 33 glass strips 35 are present in a manner corresponding to FIG. 1. As an outer wall of the cooling jacket serves a U-shaped metal profiled member 36 arranged around the tube end at the area of the display window 32, around the second window 33 and around the space 34. Said profiled member presses the second window 33 against the glass strips 35. The cooling liquid 37 flows as a result of temperature differences which occur during operation of the tube through the space 34 between the display window 32 and the second window 33 upwards (arrows 38 in FIG. 5*a*) and leaves the space 34. The cooling liquid then flows through the duct 39 in the U-shaped profiled member 36, where said liquid delivers thermal energy to the profiled member 36 and through the aperture 43 again reaches the space 34 (arrows 40 in FIG. 5*a*). The tube may be connected in a display or projection device by means of connection lugs 41.

Figure 6:
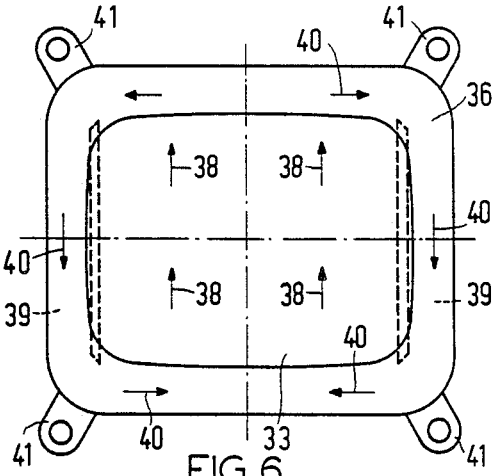
FIG. 6 is a front elevation.

FIGS. 6*a, b* and *c* are, in accordance with FIGS. 5*a, b* and *c*, a front elevation, a partial vertical sectional view and a partial horizontal sectional view, respectively, through a further embodiment of a display tube according to the invention. Said display tube comprises an evacuated envelope 50 which consists of a neck (not shown), a cone 51 and a display window 52 which comprises a display screen 53. Before the display window 52 a second window 54 is provided, a space 55 being present between said windows. As a cooling jacket serves a pipe 56 having a rectangular cross-section and provided around the display tube end at the area of the display window 52, around the second window 54 and around the space 55. The cooling liquid 57 flows as a result of temperature differences which occur during an operation of the tube through the space 55 between the display window 52 and the second window 54 (arrows 58 in FIG. 6*a*) and leaves the space 55 via apertures in the pipe 56 not visible in the figure. The cooling liquid then flows through the pipe 56 where thermal energy is delivered and reaches again the space 55 through the aperture 59 (arrows 60 in FIG. 6*a*). The tube may be connected in a display or projection device by means of connection lugs.

Figure 7:
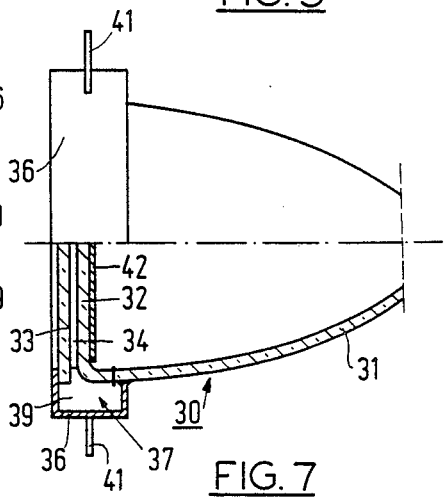
FIG. 7 is a partical vertical sectional view.

FIGS. 7*a, b* and *c* are a front elevation, a partial vertical sectional view and a partial horizontal sectional view, respectively, through a display tube according to the invention. This tube comprises an evacuated envelope 70 which consists of a neck (not shown), a cone 71 and a display window 72 which comprises a display screen 73. The second window in this case consists of a lens 74 which is provided in front of the display window 72. Between said lens 74 and the display window 72 is a space 75. The cooling jacket comprises a metal outer wall 76 which may be provided with cooling fins and is provided around the tube end at the area of the display window 72, around the lens 74 and around the space 75. The cooling liquid 77 flows through the space 75 upwards as a result of temperature difference occurring during operation of the tube. The cooling liquid then flows through the duct 78 to the duct 79 and again into the space 75 after cooling. The direction of flow is again indicated by arrows.

Figure 8:
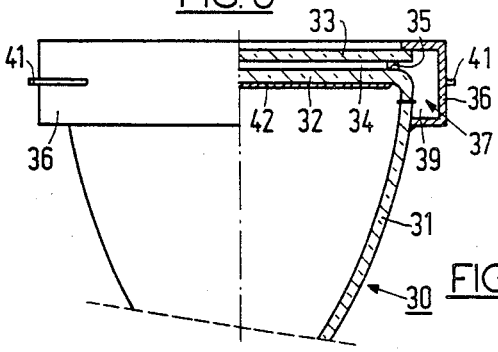
FIG. 8 is a partical horizontal sectional view through a further embodiment of a display tube according to the invention.
Figure 9:
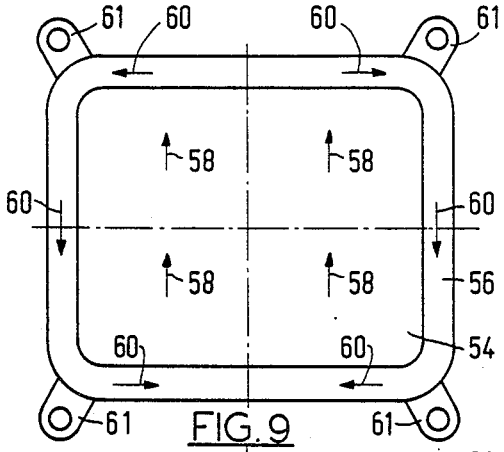
FIG. 9 is a front elevation.
Figure 10:
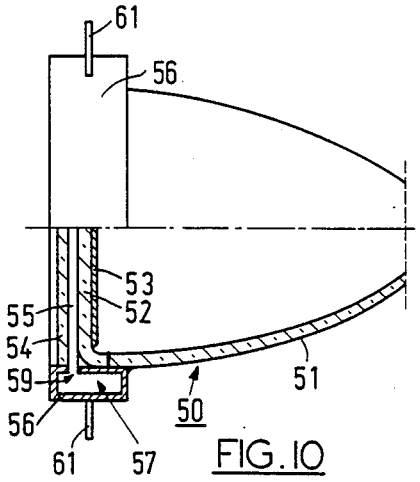
FIG. 10 is a partical vertical sectional view.
Figure 11:
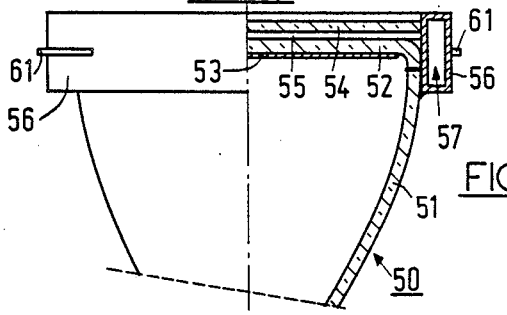
FIG. 11 is a partial horizontal sectional view through a further embodiment of such a tube.
Figure 12:
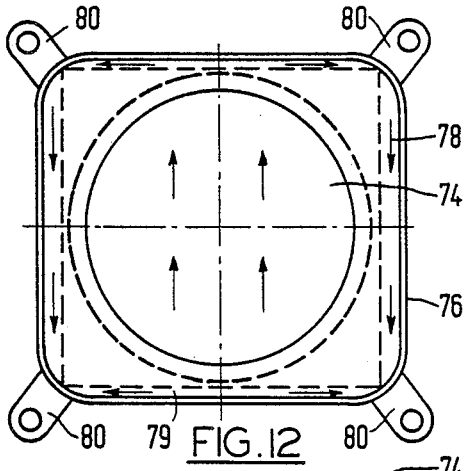
FIG. 12 is front elevation.
Figure 13:
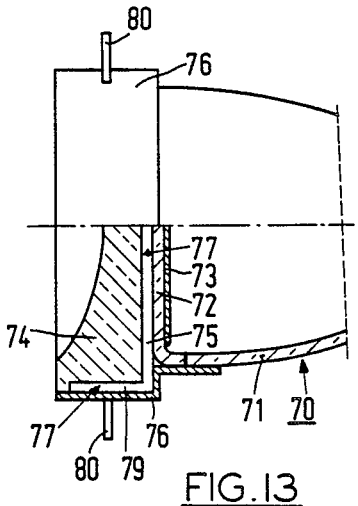
FIG. 13 is a partial vertical sectional view.
Figure 14:
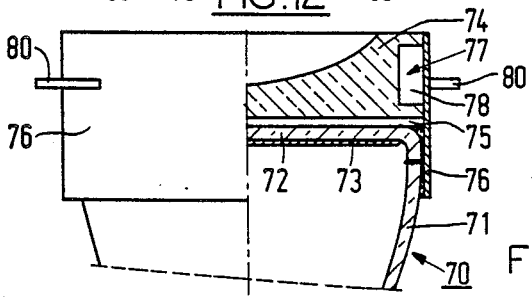
FIG. 14 is a partial horizontal sectional view through a tube according to the invention.
Figure 15:
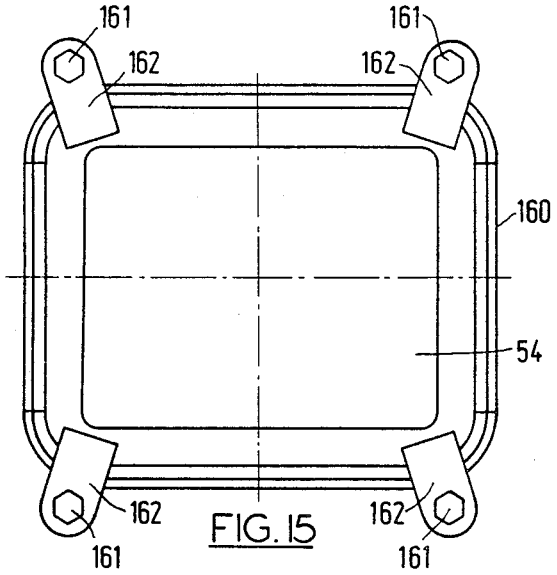
FIG. 15 is a front elevation.
Figure 16:
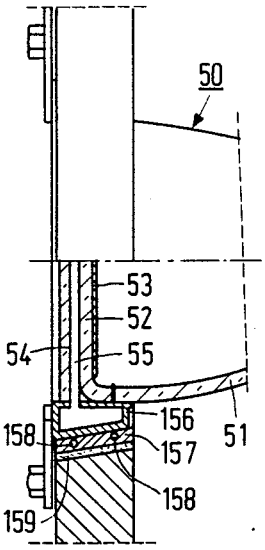
FIG. 16 is a partial vertical sectional view.
Figure 17:
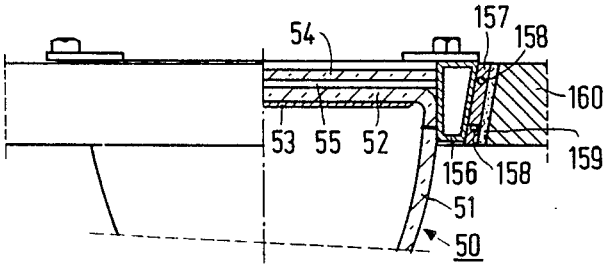
FIG. 17 is a partial horizontal sectional view through a picture display device according to the invention.

FIGS. 8*a, b* and *c* are a front elevation, a partial vertical sectional view and a partial horizontal sectional view, respectively, through a part of a picture display device having a display tube of the type shown in FIGS. 6*a, b* and *c*. The difference between the display tube shown in this figure and the FIGS. 6*a, b* and *c* is that the pipe 156 does not have a rectangular but a trapezoidal cross-section. The reference numerals in the remaining tube parts simply correspond to those of FIGS. 6*a, b* and *c*. This device comprises a second cooling system having a metal ring 157 through which cooling ducts 158 extend. Said ring 157 is provided by means of insulating material 159 so as to be thermally insulated with respect to the tube support 160. The tube is connected in the support 160 by means of bolts 161 and plates 162.

The display tubes in a dispaly device need not be provided horizontally (display window vertically). The free convection liquid flow by temperature differences also occurs with nearly vertical tubes (display window nearly horizontal). A small angle of the display tube axis to the vertical is sufficient to start a convection liquid flow. This is because the maximum difference in height in the cooling liquid in an arrangement having a tube according to the invention is larger than in the prior art tubes.

The cooling jackets (8, 36, 56, 76, 156) shown in FIGS. 1 to 8 advantageously consist at least partly of aluminium or a material having a correspondingly large thermal conductivity. As a sealing mass between, for example, the cooling jacket and the tube or the cooling jacket and the second window is preferably chosen a silicone rubber since this has a large plasticity over a wide temperature range.

It is also possible to dye the cooling liquid so as to produce in this manner a filtering of the light from the display screen.

The duct (9, 39, 56, 78) in the cooling jacket may, of course, also consist of several partial ducts.

A cooling system for a projection television display tube is also described in the European patent No. 84200785.8 corresponding to U.S. Pat. No. 4,651,047.

What is claimed is:

1. A projection television display tube having an evacuated envelope with a display window which on its inside comprises a display screen and in front of which a light permeable second window is provided on its outside, a cooling liquid flowing through the space between the display window and the second window from at least one inlet aperture to at least one outlet aperture, namely by temperature differences in said cooling liquid, characterized in that around the tube end at the area of the windows and the space a cooling jacket comprising an outer wall is provided which together with at least an outer peripheral edge of the second window defines at least one duct which transports the cooling liquid around the periphery of the window from the outlet aperture to the inlet aperture of the said space.

2. A projection television display tube having an evacuated envelope with a display window which on its inside comprises a display screen and in front of which a light permeable second window is provided on its outside, a cooling liquid flowing through the space between the display window and the second window from at least one inlet aperture to at least one outlet aperture, namely by temperature differences in said cooling liquid, characterized in that around the tube end at the area of the windows and the space a cooling jacket is provided which comprises a metal pipe having a flat wall which contacts the peripheral edges of the display window and the second window respectively, the flat wall having openings communicating with the space to form inlet and outlet apertures for the space, whereby cooling liquid is transported around the periphery of the window from the outlet aperture to the inlet aperture of the space via the metal pipe.

3. A display tube as claimed in claim 1 or 2, in which the flow resistance in the duct of the cooling jacket is smaller than in the said space.

4. A display tube as claimed in claim 1, in which at least the outer wall of the cooling jacket is of metal.

5. A display tube as claimed in claim 2 or 4, in which the outer wall of the cooling jacket comprises cooling fins.

6. A display tube as claimed in claim 1, in which the duct through which the liquid flows in bounded by a seal between the display window and the second window extending substantially parallel to the direction of flow in the space.

7. A display tube as claimed in claim 2, in which the metal pipe has a rectangular cross-section.

8. A display tube as claimed in claim 7, in which the long sides of the rectangle extending substantially parallel to the axis of the display tube.

9. A display tube as claimed in claim 7, in which the metal pipe has a cross-section whose inside is parallel to the axis of the display tube and whose outside converges towards the axis of the display tube.

10. A display tube as claimed in claim 1 or 2, in which the second window is a first element of an optical system of lenses.

11. A picture display device comprising a projection television display tube as claimed in claim 1 or 2, in which the device comprises a second cooling system to which the cooling jacket of the display tube is connected.

12. A picture display device as claimed in claim 11, in which the second cooling system is filled only partly with a cooling liquid which evaporates above a temperature of 40° to 50° C.

13. A display tube as claimed in claim 1, in which the duct is also defined by an outer edge of the display window and an edge of the cone.

14. A display tube as claimed in claim 13, in which the cooling jacket further comprises a rear wall.

15. A display tube as claimed in claim 13, in which the cooling jacket comprises a U-shaped outer wall.

* * * * *